US005218751A

United States Patent [19]

Chen et al.

[11] Patent Number: 5,218,751

[45] Date of Patent: Jun. 15, 1993

[54] METHOD OF MAKING A RESISTANCE IGNITOR FOR IGNITING GASEOUS FUEL

[75] Inventors: C. Greg Chen, River Hills, Wis.; James M. Pick, Elk Grove, Ill.; Selami Y. Pusatcioglu, Milwaukee, Wis.

[73] Assignee: Eaton Corporation, Cleveland, Ohio

[21] Appl. No.: 906,146

[22] Filed: Jun. 29, 1992

[51] Int. Cl.[5] ..... H01C 17/28

[52] U.S. Cl. ..... 29/621; 29/854; 29/863; 219/270; 219/553; 338/332; 431/262

[58] Field of Search ..... 29/621, 861–863, 29/854–856; 219/270, 552, 553; 338/332; 361/264; 431/258, 262

[56] References Cited

U.S. PATENT DOCUMENTS

| | | | |
|---|---|---|---|
| 3,372,305 | 3/1968 | Mikulec | 219/270 |
| 4,029,936 | 6/1977 | Schweitzer | 219/270 |
| 4,058,789 | 11/1977 | Bavisotto et al. | 219/553 |
| 4,969,260 | 11/1990 | Kondo et al. | 29/863 |

*Primary Examiner*—P. W. Echols
*Attorney, Agent, or Firm*—R. A. Johnston

[57] ABSTRACT

Filamentary material having a core of elemental carbon covered with a coating of silicon carbide material with a thin outer layer of elemental carbon is heated in air to cause the outer layer to oxidize. The filament is then cut to segments of a desired length, bundled and the ends metallized. A tubular metal connector is crimped over each of the metallized ends of the bundle with a conductive lead extending therefrom. The bundle assembly is then mounted onto a refractory holder.

9 Claims, 2 Drawing Sheets

METHOD OF MAKING A RESISTANCE IGNITOR FOR IGNITING GASEOUS FUEL

CROSS REFERENCE TO RELATED APPLICATIONS

This application is related to co-pending application U.S. Ser. No. 844,013, filed Feb. 28, 1992, and entitled "IGNITOR ASSEMBLY FOR GASEOUS FUEL BURNER" and assigned to the assignee of the present application.

BACKGROUND OF THE INVENTION

The present invention relates to electrical resistance or glow type ignitors for igniting gaseous fuel emanating from a burner, and particularly relates to such ignitors as employed for igniting fuel burners used in domestic ranges having top burners and an unattended burner for the enclosed oven.

Resistance ignitors of the aforesaid type have heretofore been made by firing a slurry of silicon and carbonaceous materials with minor amounts of dopant cast in a mold to form a silicon carbide composition for a shaped element having desired negative resistance properties with respect to temperature.

In the above cross-referenced application assigned to the assignee of the present invention, it was disclosed to provide a resistance ignitor having a filament of elemental carbon surrounded by a coating of silicon carbide material and plural filaments bundled with metallized ends for providing a resistance ignitor for ignition of gaseous fuel emanating from a burner.

SUMMARY OF THE INVENTION

The present invention describes a method of making a resistance ignitor of the type having a filament or bundle of filaments, each with a core of elemental carbon surrounded by a layer of silicon carbide material, and which in the green form contains a relatively thin outer layer of elemental carbon which is heated to an elevated temperature sufficient to oxidize the thin outer layer of elemental carbon onto the layer of silicon carbide material. A plurality of such filaments are cut to the desired length and bundled with the ends thereof metallized preferably by coating with a paste of material having a coefficient of thermal expansion relatively close to that of the silicon carbide and with material having a high resistance to oxidation at the elevated temperatures. Preferably, the end region of the bundle of filaments is metallized with material from the group consisting of nickel, nickel alloy, and a mixture of silver and palladium. End connections are formed of suitably oxidation-resistant metal crimped over the metallized regions and an outwardly-extending electrical lead secured against the metallized surface by the crimping operation.

DETAILED DESCRIPTION

Figure 1:
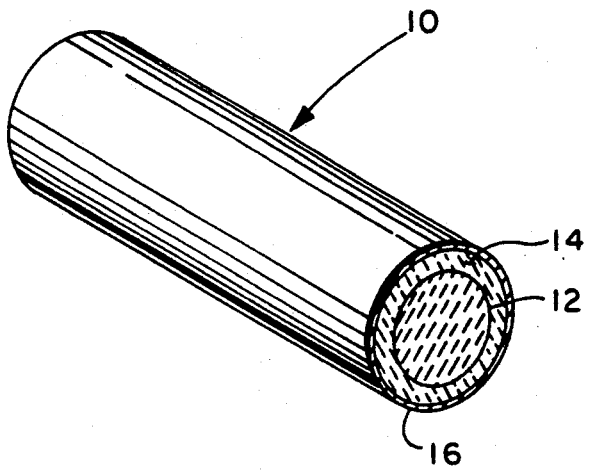
FIG. 1 is a somewhat perspective view of the "green" filamentary material employed in the present invention.

Referring to FIG. 1, the "green" filament is illustrated generally at 10 and has a core 12 formed of elemental carbon material. The core 12 is surrounded by a layer 14 formed of silicon carbide material; and, the layer 14 is encased by a thin outer layer 16 formed of elemental carbon material. In the presently preferred practice, the filament 10 is obtained from Textron Specialty Materials Corporation, 2 Industrial Avenue, Lowell, Mass. 01851, and bears the manufacturer's designation SCS-6, with a single outer carbon layer and has an overall diameter of 0.0056 inches (0.14 mm). The filament 10 is then heated to a suitable temperature in an oxidizing atmosphere such as air, and to a temperature not less than 750° C. for about thirty minutes to cause the outer elemental carbon layer to oxidize on the surface of the silicon carbide 14.

Figure 2:
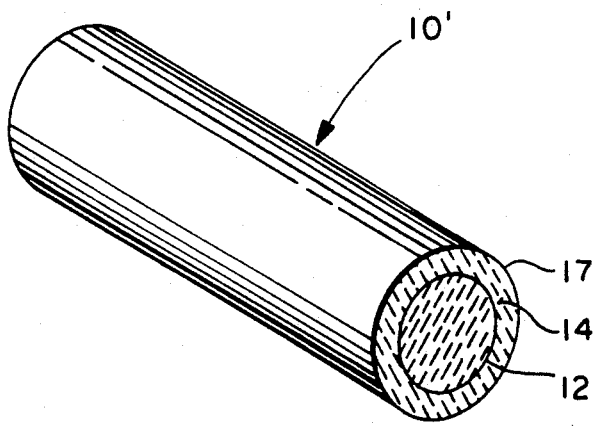
FIG. 2 is a view similar to FIG. 1, showing the material after pretreating.

Referring to FIG. 2, the heated or pretreated filament denoted generally at 10' has the outer surface 17 of the silicon carbide layer 14 in a condition in which the silicon carbide is enriched by the oxidation residue of the elemental carbon. In the presently preferred practice it has been found that the oxidizing of the relatively thin outer layer 16 of elemental carbon provides a residue on the surface 17 which enhances the life of the present invention.

In the presently preferred practice, it has been found satisfactory to oxidize the outer layer of carbon 16 for the green filament 10 by placing the filament in a furnace having an air atmosphere. However, it will be understood that the filament may also be pretreated by passing an electric current therethrough to effect the desired heating for oxidizing the outer layer.

Figure 3:
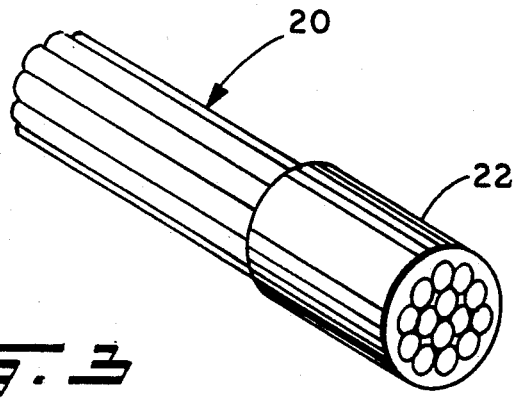
FIG. 3 is a view of the metallized end regions of the bundled assembly of the filaments of FIG. 2.

Referring to FIG. 3, the plurality of the pretreated filaments 10' are bundled into an assembly indicated generally at 20, with the end regions of the bundle metallized by coating of electrically conductive material 22 which is a high temperature resistance material, such as ductile metal, which has a relatively high surface oxidation resistance at elevated temperatures. In the presently preferred practice, the filaments are cut in lengths of the range 2–4 inches, and approximately 15–40 filaments comprise a bundle, it being understood that the number of filaments and their lengths are chosen to provide the desired resistance for the circuit employed. The present sizes and number of filaments has been found satisfactory for usage with 115 Volts AC. In the present practice of the invention, the material 22 is a paste selected from the group consisting of nickel, nickel alloy, and a mixture of silver and palladium, and is dried and then fired at a temperature of at least 750° C. to provide the suitable coating. It will be understood, however, that the material might also be chemical vapor deposited (CVD); also, it will be understood that other materials such as gold, ruthenium, platinum, or other noble metal might also be employed for the metallizing material 22.

In the presently preferred practice, a satisfactory palladium/silver mixture is obtained from Electro-Science Labs, Inc., 416 East Church Road, King of Prussia, PA 19406, which bears manufacturer's designation no. 9694 or 9695. It will be understood that, in addition to having a high resistance to oxidation and elevated temperatures, the metallizing material 22 should also have a coefficient of thermal expansion close to that of the silicon carbide material in layer 14. It has also been found satisfactory to employ a nickel powder in combination with an adhesive binder such as Durabond no. 952, obtainable from Cotronics Corporation, 3379 Shore Parkway, Brooklyn NY 11235.

Figure 4:
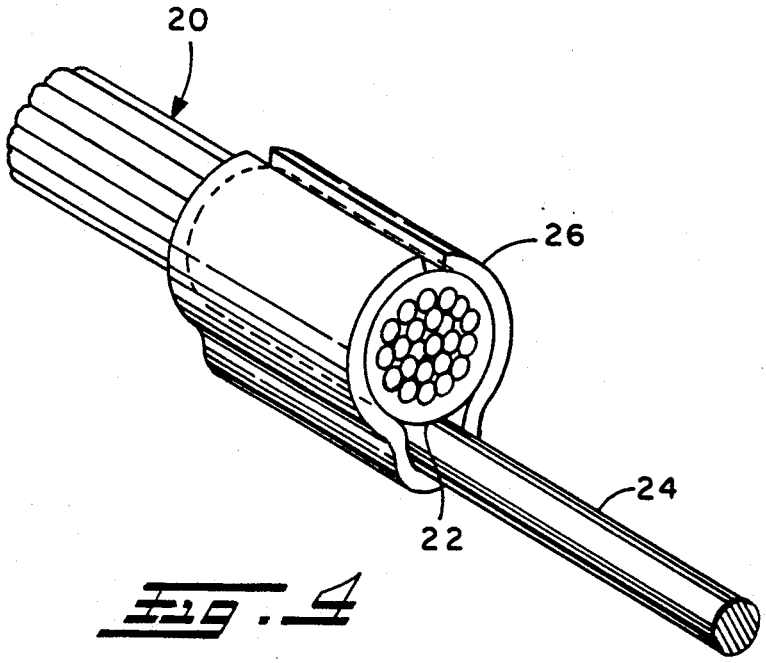
FIG. 4 is a view similar to FIG. 3, illustrating the crimped metal end connection attachments; and, FIG. 5 is a somewhat perspective view of the assembly of FIG. 4 installed in a refractory holder.

Referring now to FIG. 4, the bundle 20 with the metallized end region 22 is illustrated with a connector lead 24 in contact therewith and extending outwardly therefrom and held in place and maintained in contact with the metallized end by a suitable high temperature oxidation resistant metal connector 26 which is crimped over the end region 22 and the conductor to maintain a subassembly. It will be understood that the opposite end of the bundle 20 is prepared in the identical manner with a connector 28 and an electrical lead 30.

Figure 5:
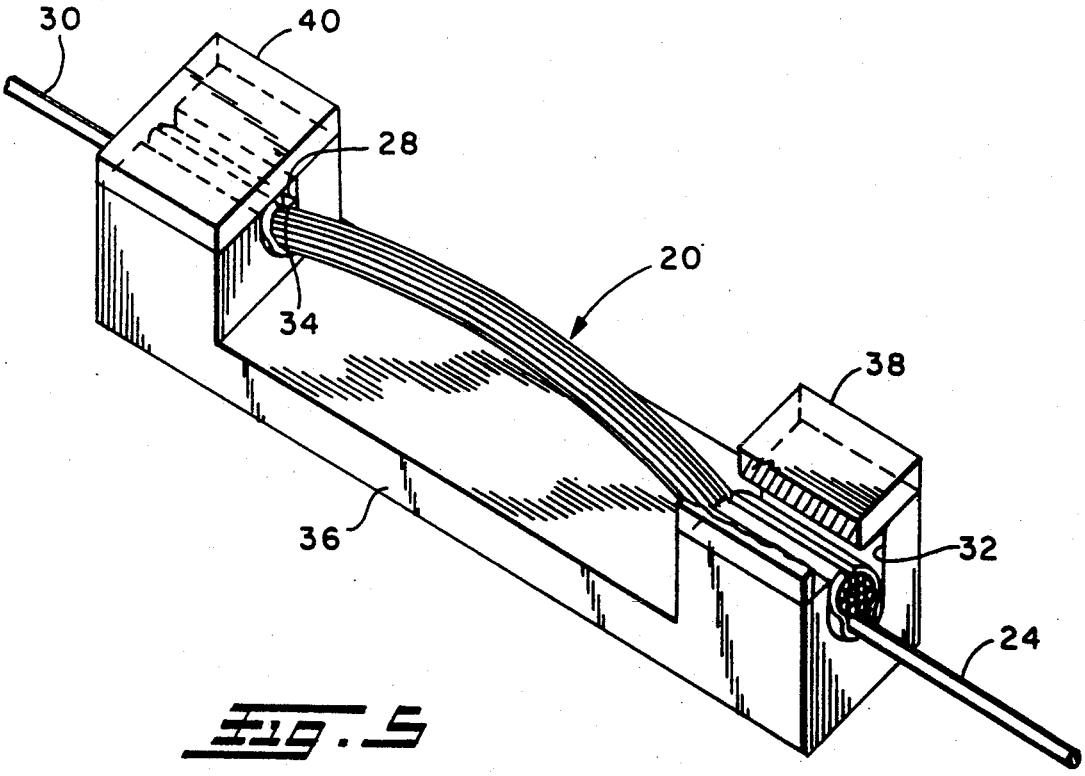

Referring to FIG. 5, the connectors 26 and 28 on the ends of the bundle 20 are received in suitable slots 32,34 provided in opposite ends of a ceramic holder 36 and are retained therein by covers 38,40 or alternatively potted with a ceramic material.

The present invention thus provides a unique and novel method of fabricating a resistance-type electrical glow ignitor for use in igniting gaseous fuel emanating from a burner. The ignitor of the present invention employs a unique process of pretreating a commercially available structural filament having an elemental carbon core and an outer coating of silicon carbide with a thin outer layer of elemental carbon which is oxidized by heating and the filaments are cut to length and bundled with the ends metallized. The metallized ends have a tubular high temperature oxidation resistant metal terminal crimped thereover to retain an electrical lead against the metallized end regions to thereby form an ignitor subassembly which is mounted on a refractory holder.

Although the present invention has hereinabove been described with respect to the illustrated embodiments, it will be understood that the invention is capable of modification and variation, and is limited only by the following claims.

We claim:

1. A method of making a resistance ignitor for gaseous fuel comprising:

(a) providing at least one elongated filament having an elemental carbon core with a coating of silicon carbide material over said core;

(b) coating the end regions of said at least one filament with conductive material having a relatively high surface oxidation resistance to elevated temperatures;

(c) providing a generally tubularly configured conductive connector and deforming portions of said connector and securing said connector onto said coated regions.

2. The method defined in claim 1, wherein the step of deforming includes securing lead means in said connector.

3. The method defined in claim 1, wherein the step of coating comprises coating with material selected from the group consisting of nickel, nickel alloy, and a mixture of silver and palladium.

4. The method defined in claim 1, wherein said coating includes applying a paste comprising a silver-palladium mixture and firing at a temperature of at least 750° C.

5. The method defined in claim 1, wherein said coating includes applying a paste comprising a conductive material having a coefficient of thermal expansion relatively close to that of said silicon carbide coating with a relatively high resistance to oxidation at the ignition temperature of said gaseous fuel.

6. The method defined in claim 1, wherein said providing includes providing a filament having a core of elemental carbon coated with silicon carbide with a relatively thin outer coating of elemental carbon and heating said filament at a temperature of at least 750° C. and oxidizing said outer layer.

7. The method defined in claim 1, wherein said providing includes providing a filament having a core of elemental carbon coated with silicon carbide having a relatively thin outer coating of elemental carbon and passing a current through said filament for heating in air to a temperature of at least 750° C. and oxidizing said outer layer.

8. The method of making a resistance ignitor for gaseous fuel comprising:

(a) providing at least one elongated filament having an elemental carbon core with a coating thereon of silicon carbide material and a relatively thin outer coating of elemental carbon;

(b) heating said filament to at least 750° C. and oxidizing said outer layer;

(c) applying a layer of conductive material having high resistance to oxidation at elevated temperatures and a coefficient of thermal expansion close to that of said filament over the end regions only of said filament.

(d) providing a generally tubular connector of material having a relatively high resistance to oxidation at elevated temperatures and deforming said connectors over each of said end regions of said filament and securing an electrical lead thereto.

9. The method defined in claim 8, wherein said applying a layer of conductive material includes metallizing said end regions of said filament.

* * * * *